US008240813B2

(12) United States Patent
Lu et al.

(10) Patent No.: US 8,240,813 B2
(45) Date of Patent: Aug. 14, 2012

(54) DIRECTED FLOW DRIP BIB FOR AN INKJET PRINTHEAD

(75) Inventors: Michael Q. Lu, Fairport, NY (US); William R. Klimley, Webster, NY (US)

(73) Assignee: Xerox Corporation, Norwalk, CT (US)

( * ) Notice: Subject to any disclaimer, the term of this patent is extended or adjusted under 35 U.S.C. 154(b) by 222 days.

(21) Appl. No.: 12/766,401

(22) Filed: Apr. 23, 2010

(65) Prior Publication Data

US 2011/0261110 A1 Oct. 27, 2011

(51) Int. Cl.
*B41J 2/165* (2006.01)

(52) U.S. Cl. ..... 347/36

(58) Field of Classification Search ..... None
See application file for complete search history.

(56) References Cited

U.S. PATENT DOCUMENTS

| | | | | |
|---|---|---|---|---|
| 5,784,089 | A * | 7/1998 | Crawford | 347/88 |
| 7,246,895 | B2 * | 7/2007 | Jones et al. | 347/88 |
| 7,455,387 | B2 * | 11/2008 | Cunnington et al. | 347/36 |
| 2004/0104959 | A1 * | 6/2004 | Brown et al. | 347/22 |
| 2007/0076048 | A1 | 4/2007 | Cunnington et al. | |
| 2007/0126783 | A1 | 6/2007 | Deshon-Stepp et al. | |
| 2008/0204535 | A1 * | 8/2008 | Sakagami | 347/102 |
| 2009/0102906 | A1 * | 4/2009 | Phillips et al. | 347/88 |

* cited by examiner

*Primary Examiner* — Matthew Luu
*Assistant Examiner* — Alejandro Valencia
(74) *Attorney, Agent, or Firm* — Maginot, Moore & Beck, LLP

(57) ABSTRACT

A drip bib has been configured for use with a printhead of an imaging device that facilitates removal of purged ink from a printhead. The drip bib includes a plate having a front face, a rear face, an upper edge, and a lower edge, and at least one elongated recess on the rear face of the plate and positioned along the upper edge of the plate, the at least one elongated recess enabling the front face of the plate to be recessed with respect to the faceplate of the printhead to which the drip bib is mounted.

13 Claims, 5 Drawing Sheets

DIRECTED FLOW DRIP BIB FOR AN INKJET PRINTHEAD

TECHNICAL FIELD

This disclosure relates generally to phase change ink jet imaging devices, and, in particular, to the printheads used in such imaging devices.

BACKGROUND

In general, ink jet printing machines or printers include at least one printhead that ejects drops or jets of liquid ink onto a recording or image forming media. A phase change ink jet printer employs phase change inks that are solid at ambient temperature, but transition to a liquid phase at an elevated temperature. The molten ink can then be ejected by a printhead to form an ink image on an image receiving member. The ink image may be formed on a layer of release agent coating an intermediate imaging member, such as a rotating drum or belt, and then the image is transferred to an image receiving substrate, such as a sheet of paper, as the substrate passes through a nip formed between a transfix roller and the intermediate imaging member. In other solid ink printing systems, the ink may be ejected directly onto printing media directed past the printheads.

In various modes of operation, ink may be purged from the printheads to ensure proper operation of the printhead. During purging, ink is typically forced through the ink pathways, chambers, and out the inkjet apertures of the faceplate of the printhead to recover missing or weak inkjet caused by foreign contaminants, air bubbles in the printhead, dried ink, broken ink meniscus around the apertures, ink movement in the printheads during docking and undocking of frame members, and other debris from, in, and around the inkjet ejectors. The purged ink flows down and off the face of the printhead typically to a waste tray positioned below the printhead. Absent any additional structure, the ink can flow freely along the bottom edge of the printhead and drip from the printhead anywhere along the bottom edge. To help control this dripping flow of waste ink, a drip bib may be added near the bottom edge of the printhead.

Previously known drip bibs were formed by generally flat plates that were secured to printheads by fasteners, such as screws or bolts. When secured to the printhead, the upper edge of these previously known drip bibs were generally in contact with the printhead adjacent the lower edge of the ejecting face along the entire drip bib upper edge. Because the previously known drip bibs were secured to the printhead with a plurality of screws, the majority of the clamping force of the fasteners against the drip bib is exerted along the contact edge of the drip bibs in the areas that are closest to the screws with lesser force being applied to the contact edge as the distance from the fasteners along the contact edge increases. This variation in clamping force can cause deformation or distortion of the drip bib, and, consequently, a corresponding distortion of the printhead. Distortion or deformation of a printhead may cause some areas of the printhead to be closer or farther away from the imaging member than others during printing which, in turn, may adversely impact the print quality of images formed by the printhead.

SUMMARY

A drip bib has been configured for use with a printhead of an imaging device that facilitates removal of purged ink from a printhead. The drip bib includes a plate having a front face, a rear face, an upper edge, and a lower edge, and at least one elongated recess on the rear face of the plate and positioned along the upper edge of the plate, the at least one elongated recess enabling the front face of the plate to be recessed with respect to the faceplate of the printhead to which the drip bib is mounted.

A printhead assembly may be configured to use the drip bib. The printhead includes a printhead having a faceplate, the printhead being configured to receive liquid ink from an ink source and to eject ink through apertures in the faceplate; and a drip bib attached to the printhead by at least one fastener, the drip bib having a plate having a front face, a rear face, an upper edge, and a lower edge, and at least one elongated recess on the rear face of the plate and positioned along the upper edge of the plate, the at least one elongated recess enabling the front face of the plate to be recessed with respect to the faceplate of the printhead to which the drip bib is mounted.

An imaging device may also be configured to use the drib bib on a plurality of printheads arranged to print a continuous line across an image receiving member. The image device includes a first upper printhead and a second upper printhead laterally positioned across a width of an image receiving surface and being laterally spaced apart from one another, the first and the second upper printheads each having a faceplate with apertures through which ink is ejected, a first lower printhead and a second lower printhead laterally spaced across the width of the image receiving surface and being laterally space apart from one another, the first and the second upper printheads each having a faceplate with apertures through which ink is ejected, the first and the second lower printheads being positioned below the first and the second upper printheads and laterally offset from the upper printheads to enable the first and the second upper printheads and the first and the second lower printheads to eject ink in a continuous line across an image receiving member passing by the four printheads, a drip bib attached to each of the first and second upper and lower printheads adjacent a lower edge of the faceplates of the first and the second upper and lower printheads, each drip bib including a plate having a front face, a rear face, an upper edge, and a lower edge, and at least one elongated recess on the rear face of the plate and positioned along the upper edge of the plate, the at least one elongated recess enabling the front face of the plate to be recessed with respect to the faceplate of the printhead to which the drip bib is mounted.

BRIEF DESCRIPTION OF THE DRAWINGS

The foregoing aspects and other features of the present disclosure are explained in the following description, taken in connection with the accompanying drawings, wherein.

DETAILED DESCRIPTION

Figure 1:
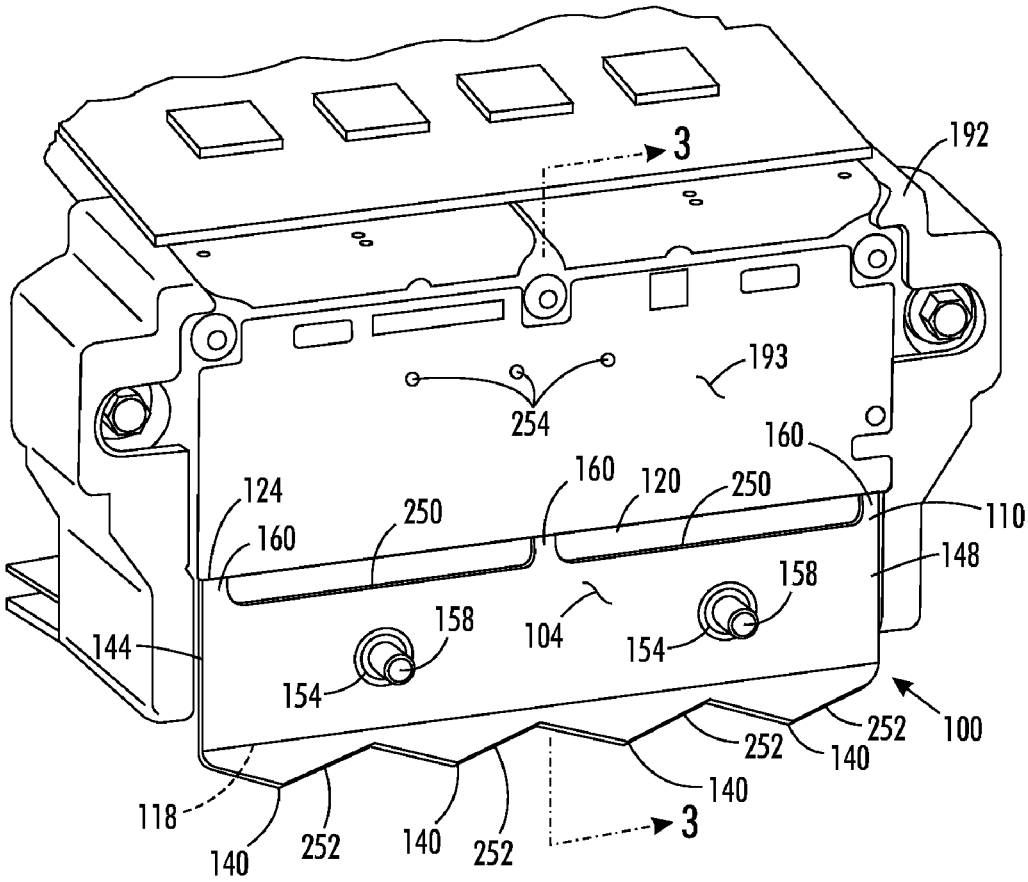
FIG. 1 is a perspective view of a printhead including an embodiment of a drip bib.

For a general understanding of the present embodiments, reference is made to the drawings. In the drawings, like reference numerals have been used throughout to designate like elements.

As used herein, the terms "printer" or "imaging device" generally refer to a device for applying an image to print media and may encompass any apparatus, such as a digital copier, bookmaking machine, facsimile machine, multi-function machine, etc. which performs a print outputting function for any purpose. "Print media" can be a physical sheet of paper, plastic, or other suitable physical print media substrate for images, whether precut or web fed. The imaging device may include a variety of other components, such as finishers, paper feeders, and the like, and may be embodied as a copier, printer, or a multifunction machine. A "print job" or "document" is normally a set of related sheets, usually one or more collated copy sets copied from a set of original print job sheets or electronic document page images, from a particular user, or otherwise related. An image generally may include information in electronic form which is to be rendered on the print media by the marking engine and may include text, graphics, pictures, and the like.

Figure 2:
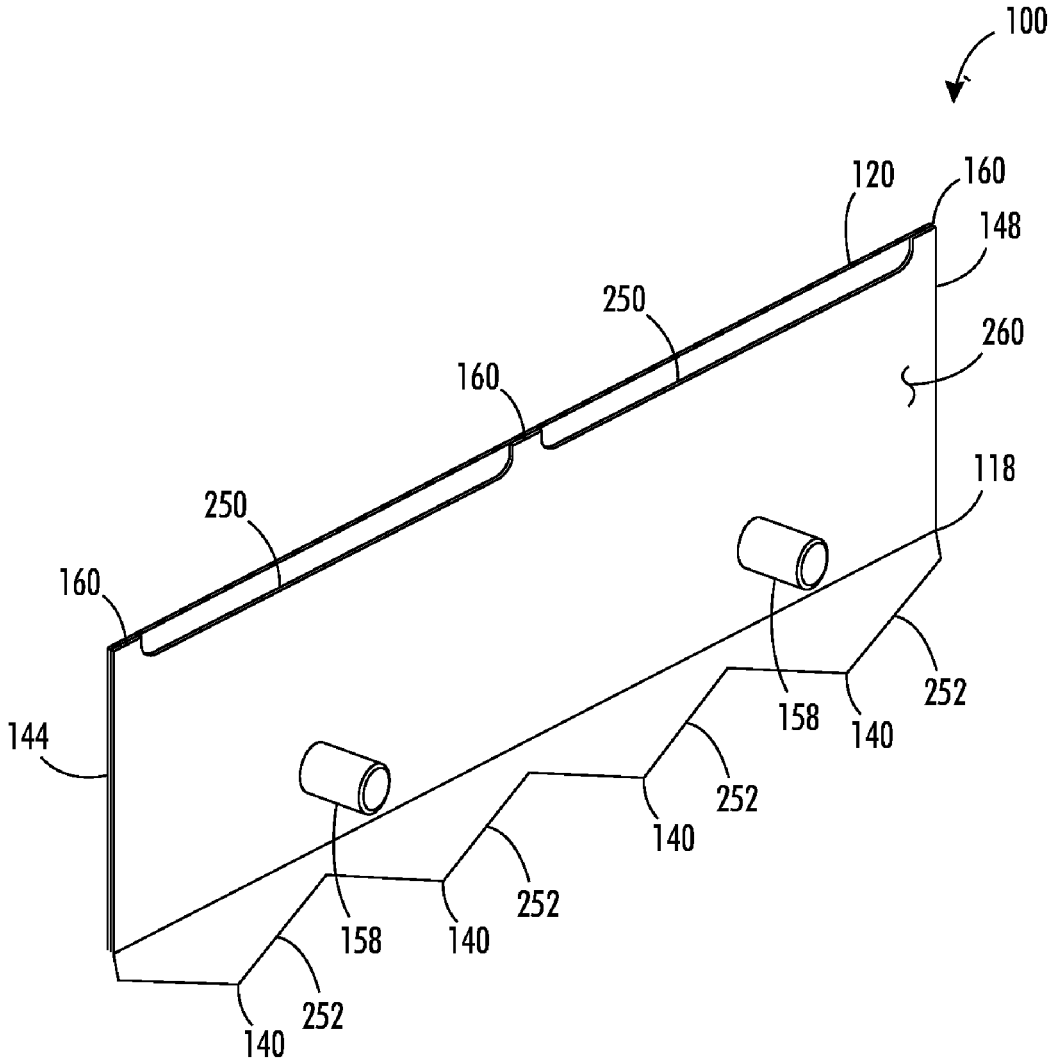
FIG. 2 is perspective view of a backside of the drip bib of the printhead of FIG. 1.
Figure 3:
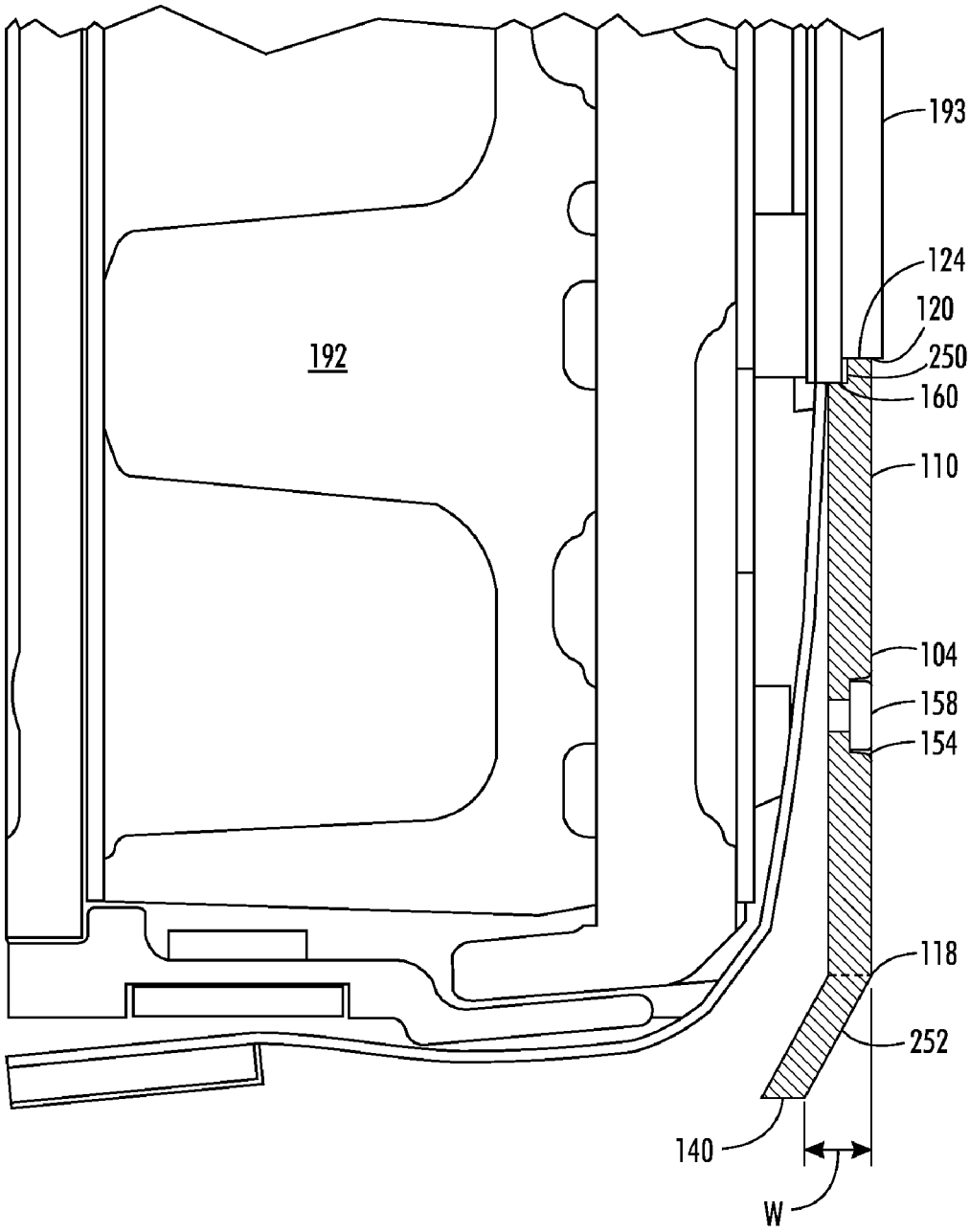
FIG. 3 is a side cross-sectional view of the drip bib of FIG. 1 taken along line 3-3.

Referring to FIGS. 1-3, an exemplary printhead 192 is shown. The printhead 192 is part of a phase change ink printer. The image producing machine or the printer also includes a melting and control apparatus (not shown) for melting a phase-change ink from a solid form into a liquid form. The printhead 192 has a faceplate 193 for ejecting ink through apertures 254 onto an imaging/receiving surface (not shown) to form an image. A lower edge 124 constitutes the bottom edge of the faceplate 193.

A drip bib 100 may be mounted to the printhead 192 by fasteners 158, e.g., threaded bolts, through fastener openings 154. As used herein, fastener means a member that is received through an opening in a plate to be received in another structure to entrap a portion of the plate and secure the plate to another structure. Although fasteners are frequently used to secure drib bibs to printheads, mounting may be achieved using adhesives, tab-and-slot configurations, or other known mounting methods and components. In the embodiment of FIGS. 1-2, two fasteners 158 are used to secure the drip bib 100 to the printhead 192, although, in other embodiments, more or fewer, e.g., one fastener, may be utilized. The two fasteners 158, and the respective fastener openings 154, are equilaterally spaced from each other and from the side edges of the drip bib 100. The two fasteners 158 are also equidistant from the top edge 120. The drip bib 100 comprises a metal plate, such as stainless steel or aluminum, having a one-piece construction that may be manufactured using conventional sheet metal forming techniques. Other suitable material or combination of materials, however, may be utilized for the drip bib plate including other metals and/or rigid plastic materials.

The drip bib 100 includes an upper surface 110 defining an upper edge 120, a lower edge 118, at least one angled triangular extension 252, a front face 104, and a rear face 260 (FIG. 2). When the drip bib 100 is secured to the printhead 192, the upper surface 110 is below and generally parallel to the faceplate 193 of the printhead 192, as depicted in FIG. 1. The upper surface 110 of the drip bib 100 is positioned with respect to the faceplate 193 so that the contact edge 120 of the drip bib 100 abuts the lower edge 124 of the faceplate 193 and is recessed from the faceplate 193, as best shown in FIG. 3. A coating may be applied to the front face 104 of the drip bib 100 to facilitate the movement of ink down the drip bib to the points of the triangular extensions 252. The coating may be made of polytetrafluoroethylene or perfluoroalkoxy.

The upper surface 110 of the drip bib 100 includes load points 160 (FIG. 1) and elongated recesses 250 (shown as dashed lines in FIG. 1 and shown on the rear surface 260 in FIG. 2). The load points 160 coincide with structural features of the printhead 192 to provide a robust interface between the printhead 192 and the drip bib 100. Without the load points 160, the drip bib 100 may experience uneven contact pressure between the upper edge 120 of the drip bib 100 and the lower edge 124 of the faceplate 193 from the clamping force of the fasteners when the drip bib 100 is secured to the printhead 192. Thus, the clamping force may cause a corresponding distortion or deformation of the printhead faceplate 193. This distortion may occur whether the fastener openings 154 are equilaterally spaced from each other and from the side edges of the drip bib 100, equidistant from the upper edge 120, or, even if only one fastener opening 154 is used, centrally located on the drip bib 100. The load points 160 help alleviate this possible distortion.

The elongated recesses 250 between the load points 160 allow the drip bib 100 fit under the faceplate 193 so the upper edge 110 is recessed with respect to the bottom edge 124 of the faceplate 193. Referring to FIG. 3, the elongated recesses 250 provide pockets that are configured to receive portions of the printhead 192 so the front face 104 is not pushed beyond the faceplate 193. The load points are located at the ends of the elongated recesses 250 along the upper edge 110. In the embodiment of FIGS. 1-2, the load points 160 are formed by removing material from the upper edge 110 to provide the elongated recesses 250. In an alternative embodiment, after forming the elongated recesses 250, additional material can be added to the load points 160, e.g., by welding small square-shaped pieces, in order to further strengthen the drip bib 100 at the point of contact with the faceplate 193. The extra thickness of the load points should, however, maintain the recessed relationship between the drip bib 100 and the faceplate 193.

The triangular extensions 252 are angled to extend behind the rear face 260 of the bib 100 along the lower edge 118 to form one or more directional flow paths. These flow paths direct droplets of ink down the faceplate 193 of the printhead 192, as described further below. The angled triangular extensions 252 may also be curled or rounded. These triangular extensions 252 define areas for collecting ink from the front face 104 of the drip bib 100 and directing the ink to the points of the triangular extensions 252 where the droplets can fall into a catch tray (not shown). The triangular extension 252 may be angled in such a way to provide a width W from the front face 104 to the point of the triangles. The width W may be configured to provide an appropriate clearance for the tray that is placed below the printhead 192.

In various modes of operation, ink may be purged from the apertures 254 of the printhead 192 to ensure proper operation of the printhead. When ink is purged through the printhead, the ink flows down and off the faceplate 193 of the printhead 192. Commonly, during a cleaning cycle, a scraper or wiper blade (not shown) may also be drawn across the ink ejecting faceplate 193 of the printhead 192 to squeegee away any excess liquid phase ink that may collect on the faceplate 193. The recessing of the upper edge 110 of the bib 100 provided by the recessed openings 250 enable the wiper blade to stop its motion below the faceplate 193 to help ensure the ink is completely removed from the faceplate and deposited on the bib 100. If the upper edge 110 extended beyond the faceplate 193, the wiper blade would leave a horizontal line of liquid ink on the faceplate 193 near the bottom edge 124. Such an ink line is commonly referred to as a witness line. Absent the drip bib 100, the ink moved by a wiper blade to the bottom edge 124 of the faceplate 193 can drip from the printhead 192 anywhere along the bottom edge 124 in an unpredictable manner. Some droplets, however, may remain in the witness line at the bottom edge 124.

Figure 4:
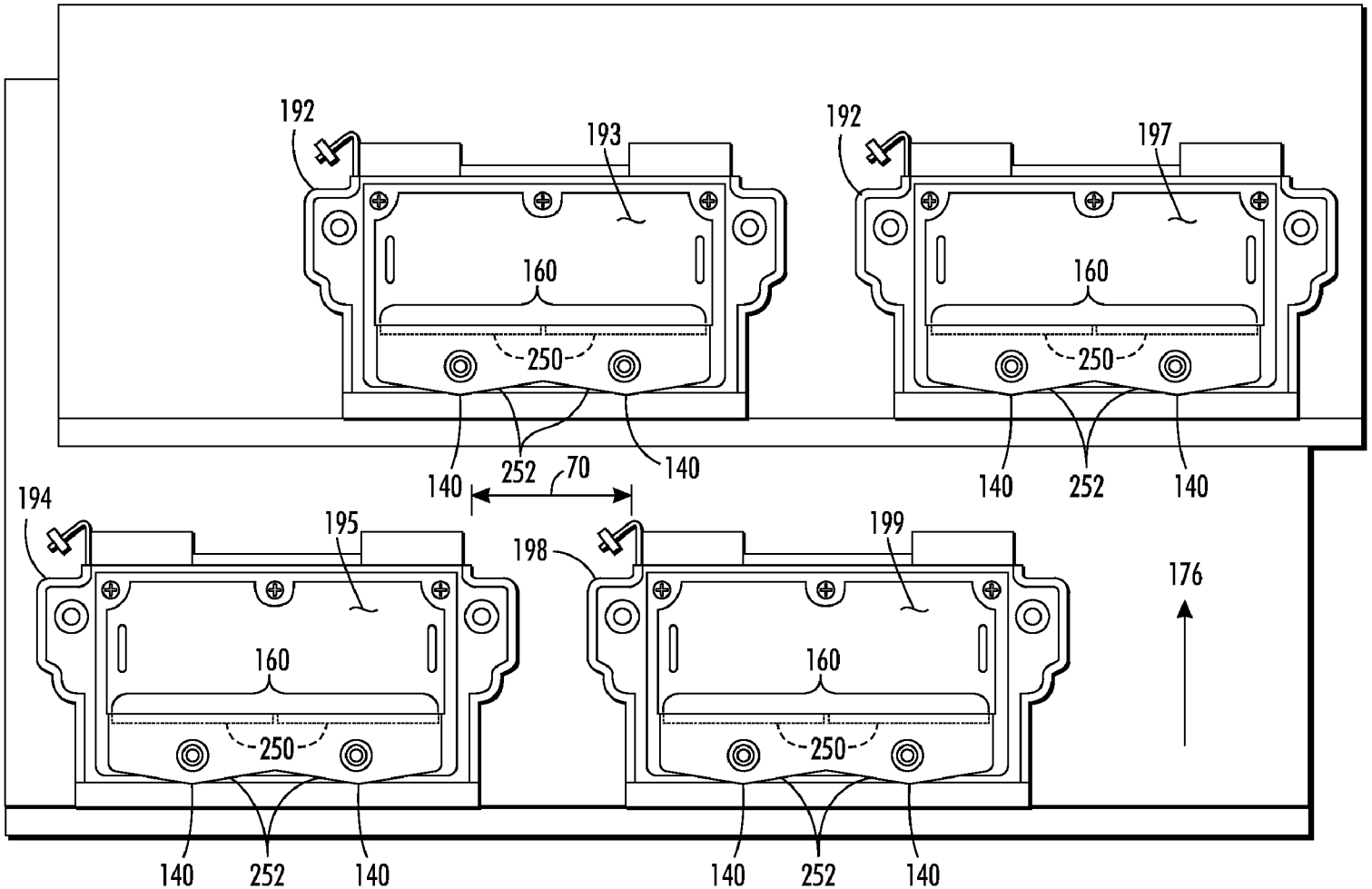
FIG. 4 is a front elevational view of a printhead system showing staggered printheads in two rows.

Once printing operations resume and the imaging/receiving surface moves by the printhead 192 at a high rate of speed, air is pushed by the imaging surface towards the printhead 192. This air flow may be sufficient to push ink in the witness line at the bottom edge 124 upward into the apertures in the faceplate 193. This ink may clog apertures or otherwise interfere with the ejection of ink from the printhead. Additionally, the ink that falls from the bottom edge 124 in the absence of a bib 100 may land on a lower printhead, particularly in a printhead assembly having a staggered printhead arrangement as shown in FIG. 4. The ink landing on the lower printheads may cause a variety of problems, including: color mixing in the printhead aperture plate, ease of ink drooling out of the printhead apertures, or contamination of the imaging surface. The ink may also inhibit the range of motion of motors or pivoting action in the area that controls printhead movement.

To help control the flow of waste ink from the faceplate 193 of the printhead 192, a drip bib 100 having the features shown in FIG. 1-3 may be added at the bottom edge 124 of the faceplate 193. With such a bib in place, a wiper blade deposits the ink of a witness line on the front face 104 of the bib 100 where the ink tends to flow to the lower edge 118 and towards the angled triangular extensions 252 of the drip bib 100. This flow is enhanced the coating on the drip bib 100 that reduces the surface tension on the front face 104. Thus, ink flow over the front face 104 of the drip bib plate is facilitated on a front face that is coated as compared to the front face of a drip bib plate that is uncoated.

The shapes of the triangular extensions 252 direct the ink droplets on paths toward drip points 140 of the triangles. The drip points 140 are positioned along the lower edge 118 at the termination points of the collecting areas formed by the angled triangular extensions 252. The drip points 140 direct the flow of ink from the tips into the catch tray. The drip points 140 may have any suitable configuration that enables ink to drip or flow in a controlled manner from the drip point. In the embodiment of FIGS. 1-2, the drip points 140 are shaped as points of triangles. The drip points, however, may have any suitable shape including rounded shapes. In addition, the drip points 140 are strategically positioned at predetermined locations along the lower edge 118 of the drip bib 100 to enable the flow of waste ink to be directed in a controlled manner that avoids, for example, splashing ink onto other printheads or systems within the imaging device. As a result, the ink droplets fall off the angled triangular extensions 252 at predictable locations. While four angled triangular extensions 252 terminating at four drip points 140 are shown in FIGS. 1-2, in other alternative embodiments fewer or more extensions may be used. For example, as further discussed below with reference to FIG. 4, staggered printheads each have two angled triangular extensions 252 terminating in two drip points 140.

The recessed feature of the drip bib 100 with respect to the faceplate 193 provides several advantages. First, the purged ink droplets that collect at the bottom edge 124 of the faceplate 100 fall on to the front face 104 of the drip bib 100. Therefore, in the normal purging operation, the ink droplets cannot roll and pool at the bottom edge 124 and behind the faceplate 192. Second, as mentioned above, with an imaging/receiving surface passing by the faceplate 193 and the drip bib 100 at a high rate of speed, the air between the imaging/receiving surface and these structures tends to push ink droplets upward. However, because of the step formed by the drip bib-faceplate interface, the ink droplets that have fallen on to the front face 104 cannot travel over the step onto the faceplate. In other words, the drip bib-faceplate interface acts as a one-way valve that allows ink droplets to travel from the faceplate 193 on to the front face 104 but not vice versa. Third, since the front face 104 of the drip bib 100 is recessed with respect to the faceplate 193 of the printhead 192 and further since the triangular extensions 252 are angled inward (to the left as shown in FIG. 3), the drip bib 100 does not require any additional clearance to avoid interference with other objects, e.g., a housing or another printhead.

Referring to FIG. 3, the fastener openings 154 are formed as recessed features through which the fasteners 158 are extended to affix the drip bib 100 to the printhead 192. The fastener openings are designed to prevent the fasteners 158 from protruding beyond the front face 104 (in the fastened state) to avoid requiring additional clearance for the drip bib 100.

Referring now to FIG. 4, a printer/copier 170 described in this example is a high-speed, or high throughput, multicolor image producing machine, having four printheads, including upper printheads 192 and 196, and lower printheads 194 and 198. Each printhead 192, 194, 196 and 198 has a corresponding faceplate 193, 195, 197 and 199 for ejecting ink onto the imaging/receiving surface to form an image. While forming an image in a mode, referred to herein as the print mode, the upper printheads 192, 196 may be staggered with respect to the lower printheads 194, 198 in a direction transverse to the receiving surface path 176 in order to cover different portions of the imaging/receiving surface. The staggered arrangement enables the printheads to form an image across the full width of the substrate. In the print mode, the printhead faceplates 193, 195, 197, 199 are disposed close to the imaging/receiving surface, for example by about 23 mils.

The positions of drip points 140, at least on the drip bibs of the upper printheads 192 and 196, enable the waste ink generated by the upper printheads 192 and 196 to be directed through gaps between the lower printheads. For example, referring to FIG. 4, upper printhead 192 is positioned above the two lower printheads 194 and 198 such that the drip points 140 of the drip bib 100 of the printhead 192 are located directly above a lateral gap 70 between the two lower printheads 194 and 198. The waste ink from the printhead 192 is then directed in streams from the drip points 140 of printhead 192 between the two lower printheads 194 and 198 into a waste tray (not shown) so the waste ink does not drip or splash onto the lower printheads 194 and 198.

Figure 5:
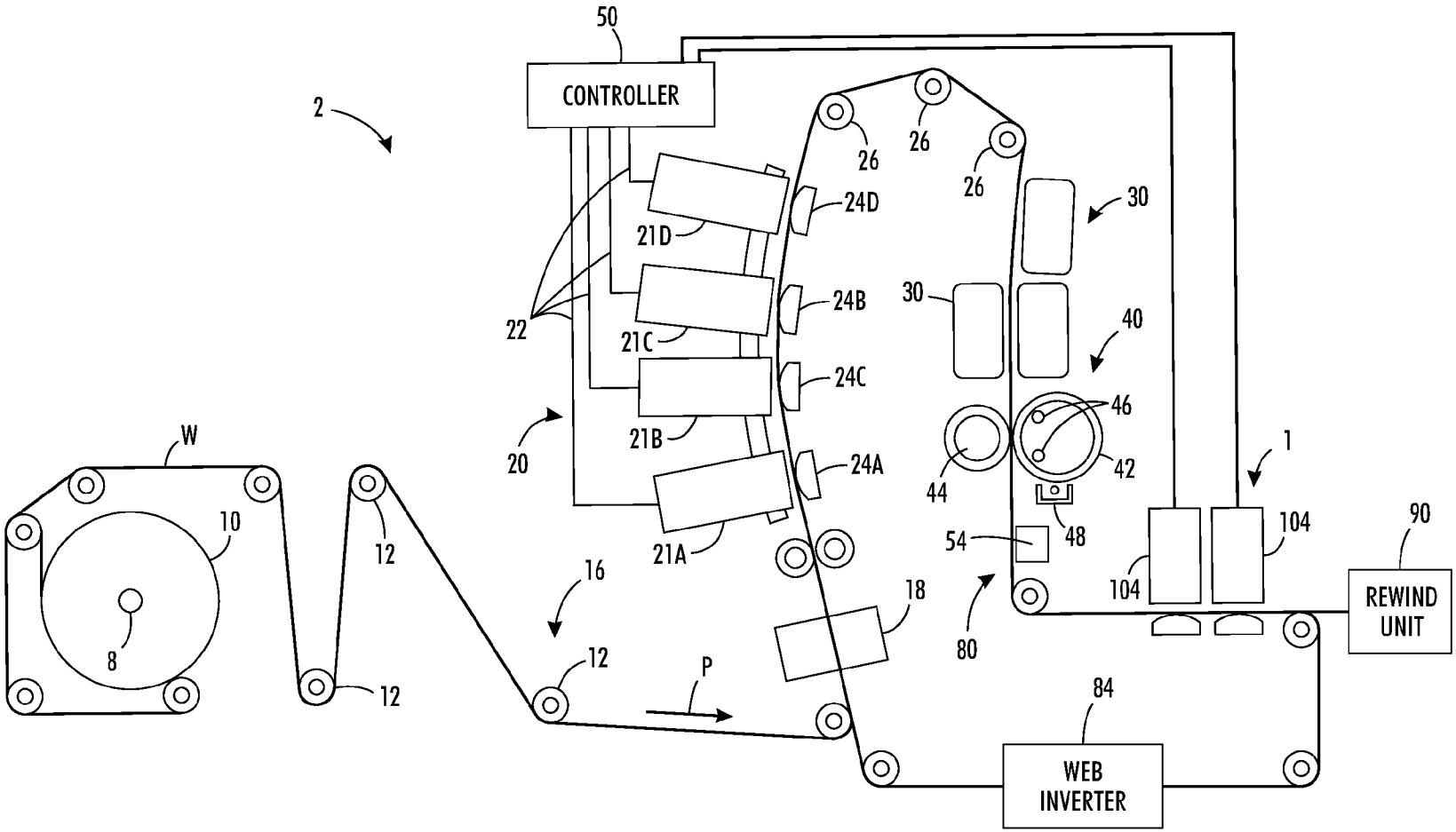
FIG. 5 is a schematic view of a prior art inkjet imaging system that ejects ink onto a continuous web of media as the media moves past the printheads in the system.

Referring now to FIG. 5, an embodiment of an image producing machine, such as a high-speed phase change ink image producing machine or printer 2 of the present disclosure, is depicted. For the purposes of this disclosure, the imaging apparatus is in the form of an inkjet printer that employs one or more inkjet printheads and an associated solid ink supply. However, the drip bib described herein is applicable to any of a variety of other imaging apparatus that use printheads with inkjet ejectors to eject one or more colorants onto an image receiving member. The imaging apparatus includes a print engine to process the image data before generating the control signals for the inkjet ejectors. The colorant may be ink, or any suitable substance that includes one or more dyes or pigments and that may be applied to the selected media. The colorant may be black, or any other desired color, and a given imaging apparatus may be capable of applying a plurality of distinct colorants to the media. The media may include any of a variety of substrates, including plain paper, coated paper, glossy paper, or transparencies, among others, and the media may be available in sheets, rolls, or another physical formats.

FIG. 5 is a simplified schematic view of a direct-to-sheet, continuous-media, phase-change inkjet imaging system 2, that may be modified to generate the test patterns and adjust printheads using the methods discussed above. A media supply and handling system is configured to supply a long (i.e., substantially continuous) web of media W of "substrate" (paper, plastic, or other printable material) from a media source, such as spool of media 10 mounted on a web roller 8. For simplex printing, the printer is comprised of feed roller 8, media conditioner 16, printing station 20, printed web conditioner 80, coating station 1, and rewind unit 90. For duplex operations, the web inverter 84 is used to flip the web over to present a second side of the media to the printing station 20, printed web conditioner 80, and coating station 1 before being taken up by the rewind unit 90. In the simplex operation, the media source 10 has a width that substantially covers the width of the rollers over which the media travels through the printer. In duplex operation, the media source is approximately one-half of the roller widths as the web travels over one-half of the rollers in the printing station 20, printed web conditioner 80, and coating station 1 before being flipped by the inverter 84 and laterally displaced by a distance that enables the web to travel over the other half of the rollers opposite the printing station 20, printed web conditioner 80, and coating station 1 for the printing, conditioning, and coating, if necessary, of the reverse side of the web. The rewind unit 90 is configured to wind the web onto a roller for removal from the printer and subsequent processing.

The media may be unwound from the source 10 as needed and propelled by a variety of motors, not shown, rotating one or more rollers. The media conditioner includes rollers 12 and a pre-heater 18. The rollers 12 control the tension of the unwinding media as the media moves along a path through the printer. In alternative embodiments, the media may be transported along the path in cut sheet form in which case the media supply and handling system may include any suitable device or structure that enables the transport of cut media sheets along a desired path through the imaging device. The pre-heater 18 brings the web to an initial predetermined temperature that is selected for desired image characteristics corresponding to the type of media being printed as well as the type, colors, and number of inks being used. The pre-heater 18 may use contact, radiant, conductive, or convective heat to bring the media to a target preheat temperature, which in one practical embodiment, is in a range of about 30° C. to about 70° C.

The media is transported through a printing station 20 that includes a series of printhead modules, which are sometimes known as print box units, 21A, 21B, 21C, and 21D, each printhead module effectively extending across the width of the media and being able to place ink directly (i.e., without use of an intermediate or offset member) onto the moving media. As is generally familiar, each of the printheads may eject a single color of ink, one for each of the colors typically used in color printing, namely, cyan, magenta, yellow, and black (CMYK). Additionally, each printhead may be configured with the drip bib discussed above to facilitate the removal of ink from the faceplates of the printheads and to direct the waste ink into a waste tray (not shown). The controller 50 of the printer receives velocity data from encoders mounted proximately to rollers positioned on either side of the portion of the path opposite the four printheads to compute the position of the web as moves past the printheads. The controller 50 uses these data to generate timing signals for actuating the inkjet ejectors in the printheads to enable the four colors to be ejected with a reliable degree of accuracy for registration of the differently color patterns to form four primary-color images on the media. The inkjet ejectors actuated by the firing signals corresponds to image data processed by the controller 50. The image data may be transmitted to the printer, generated by a scanner (not shown) that is a component of the printer, or otherwise generated and delivered to the printer. In various possible embodiments, a printhead module for each primary color may include one or more printheads; multiple printheads in a module may be formed into a single row or multiple row array; printheads of a multiple row array may be staggered; a printhead may print more than one color; or the printheads or portions thereof can be mounted movably in a direction transverse to the process direction P, such as for spot-color applications and the like.

The printer may use "phase-change ink," by which is meant that the ink is substantially solid at room temperature and substantially liquid when heated to a phase change ink melting temperature for jetting onto the imaging receiving surface. The phase change ink melting temperature may be any temperature that is capable of melting solid phase change ink into liquid or molten form. In one embodiment, the phase change ink melting temperature is approximately 70° C. to 140° C. In alternative embodiments, the ink utilized in the imaging device may comprise UV curable gel ink. Gel ink may also be heated before being ejected by the inkjet ejectors of the printhead. As used herein, liquid ink refers to melted solid ink, heated gel ink, or other known forms of ink, such as aqueous inks, ink emulsions, ink suspensions, ink solutions, or the like.

Associated with each printhead module is a backing member 24A-24D, typically in the form of a bar or roll, which is arranged substantially opposite the printhead on the back side of the media. Each backing member is used to position the media at a predetermined distance from the printhead opposite the backing member. Each backing member may be configured to emit thermal energy to heat the media to a predetermined temperature which, in one practical embodiment, is in a range of about 40° C. to about 60° C. The various backer members may be controlled individually or collectively. The pre-heater 18, the printheads, backing members 24 (if heated), as well as the surrounding air combine to maintain the media along the portion of the path opposite the printing station 20 in a predetermined temperature range of about 40° C. to 70° C.

As the partially-imaged media moves to receive inks of various colors from the printheads of the printing station 20, the temperature of the media is maintained within a given range. Ink is ejected from the printheads at a temperature typically significantly higher than the receiving media temperature. Consequently, the ink heats the media. Therefore other temperature regulating devices may be employed to maintain the media temperature within a predetermined range. For example, the air temperature and air flow rate behind and in front of the media may also impact the media temperature. Accordingly, air blowers or fans may be utilized to facilitate control of the media temperature. Thus, the media temperature is kept substantially uniform for the jetting of all inks from the printheads of the printing station 20. Temperature sensors (not shown) may be positioned along this portion of the media path to enable regulation of the media temperature. These temperature data may also be used by systems for measuring or inferring (from the image data, for example) how much ink of a given primary color from a printhead is being applied to the media at a given time.

Following the printing zone 20 along the media path are one or more "mid-heaters" 30. A mid-heater 30 may use contact, radiant, conductive, and/or convective heat to control a temperature of the media. The mid-heater 30 brings the ink placed on the media to a temperature suitable for desired properties when the ink on the media is sent through the spreader 40. In one embodiment, a useful range for a target temperature for the mid-heater is about 35° C. to about 80° C. The mid-heater 30 has the effect of equalizing the ink and substrate temperatures to within about 15° C. of each other. Lower ink temperature gives less line spread while higher ink temperature causes show-through (visibility of the image from the other side of the print). The mid-heater 30 adjusts substrate and ink temperatures to 0° C. to 20° C. above the temperature of the spreader.

Following the mid-heaters 30, a fixing assembly 40 is configured to apply heat and/or pressure to the media to fix the images to the media. The fixing assembly may include any suitable device or apparatus for fixing images to the media including heated or unheated pressure rollers, radiant heaters, heat lamps, and the like. In the embodiment of the FIG. 5, the fixing assembly includes a "spreader" 40, that applies a predetermined pressure, and in some implementations, heat, to the media. The function of the spreader 40 is to take what are essentially droplets, strings of droplets, or lines of ink on web W and smear them out by pressure and, in some systems, heat, so that spaces between adjacent drops are filled and image solids become uniform. In addition to spreading the ink, the spreader 40 may also improve image permanence by increasing ink layer cohesion and/or increasing the ink-web adhesion. The spreader 40 includes rollers, such as image-side roller 42 and pressure roller 44, to apply heat and pressure to the media. Either roll can include heat elements, such as heating elements 46, to bring the web W to a temperature in a range from about 35° C. to about 80° C. In alternative embodiments, the fixing assembly may be configured to spread the ink using non-contact heating (without pressure) of the media after the print zone. Such a non-contact fixing assembly may use any suitable type of heater to heat the media to a desired temperature, such as a radiant heater, UV heating lamps, and the like.

In one practical embodiment, the roller temperature in spreader 40 is maintained at a temperature to an optimum temperature that depends on the properties of the ink such as 55° C.; generally, a lower roller temperature gives less line spread while a higher temperature causes imperfections in the gloss. Roller temperatures that are too high may cause ink to offset to the roll. In one practical embodiment, the nip pressure is set in a range of about 500 to about 2000 psi lbs/side. Lower nip pressure gives less line spread while higher pressure may reduce pressure roller life.

The spreader 40 may also include a cleaning/oiling station 48 associated with image-side roller 42. The station 48 cleans and/or applies a layer of some release agent or other material to the roller surface. The release agent material may be an amino silicone oil having viscosity of about 10-200 centipoises. Only small amounts of oil are required and the oil carried by the media is only about 1-10 mg per A4 size page. In one possible embodiment, the mid-heater 30 and spreader 40 may be combined into a single unit, with their respective functions occurring relative to the same portion of media simultaneously. In another embodiment the media is maintained at a high temperature as it is printed to enable spreading of the ink.

The coating station 1 applies a clear ink to the printed media. This clear ink helps protect the printed media from smearing or other environmental degradation following removal from the printer. The overlay of clear ink acts as a sacrificial layer of ink that may be smeared and/or offset during handling without affecting the appearance of the image underneath. The coating station 1 may apply the clear ink with either a roller or a printhead 104 ejecting the clear ink in a pattern. Clear ink for the purposes of this disclosure is functionally defined as a substantially clear overcoat ink that has minimal impact on the final printed color, regardless of whether or not the ink is devoid of all colorant. In one embodiment, the clear ink utilized for the coating ink comprises a phase change ink formulation without colorant. Alternatively, the clear ink coating may be formed using a reduced set of typical solid ink components or a single solid ink component, such as polyethylene wax, or polywax. As used herein, polywax refers to a family of relatively low molecular weight straight chain poly ethylene or poly methylene waxes. Similar to the colored phase change inks, clear phase change ink is substantially solid at room temperature and substantially liquid or melted when initially jetted onto the media. The clear phase change ink may be heated to about 100° C. to 140° C. to melt the solid ink for jetting onto the media.

Following passage through the spreader 40 the printed media may be wound onto a roller for removal from the system (simplex printing) or directed to the web inverter 84 for inversion and displacement to another section of the rollers for a second pass by the printheads, mid-heaters, spreader, and coating station. The duplex printed material may then be wound onto a roller for removal from the system by rewind unit 90. Alternatively, the media may be directed to other processing stations that perform tasks such as cutting, binding, collating, and/or stapling the media or the like.

Operation and control of the various subsystems, components and functions of the device 2 are performed with the aid of the controller 50. The controller 50 may be implemented with general or specialized programmable processors that execute programmed instructions. The instructions and data required to perform the programmed functions may be stored in memory associated with the processors or controllers. The processors, their memories, and interface circuitry configure the controllers and/or print engine to perform the functions, such as the difference minimization function, described above. These components may be provided on a printed circuit card or provided as a circuit in an application specific integrated circuit (ASIC). Each of the circuits may be implemented with a separate processor or multiple circuits may be implemented on the same processor. Alternatively, the circuits may be implemented with discrete components or circuits provided in VLSI circuits. Also, the circuits described herein may be implemented with a combination of processors, ASICs, discrete components, or VLSI circuits.

The imaging system 2 may also include an optical imaging system 54 that is configured in a manner similar to that described above for the imaging of the printed web. The optical imaging system is configured to detect, for example, the presence, intensity, and/or location of ink drops jetted onto the receiving member by the inkjets of the printhead assembly. The light source for the imaging system may be a single light emitting diode (LED) that is coupled to a light pipe that conveys light generated by the LED to one or more openings in the light pipe that direct light towards the image substrate. In one embodiment, three LEDs, one that generates green light, one that generates red light, and one that generates blue light are selectively activated so only one light shines at a time to direct light through the light pipe and be directed towards the image substrate. In another embodiment, the light source is a plurality of LEDs arranged in a linear array. The LEDs in this embodiment direct light towards the image substrate. The light source in this embodiment may include three linear arrays, one for each of the colors red, green, and blue. Alternatively, all of the LEDS may be arranged in a single linear array in a repeating sequence of the three colors. The LEDs of the light source may be coupled to the controller 50 or some other control circuitry to activate the LEDs for image illumination.

The reflected light is measured by the light detector in optical sensor 54. The light sensor, in one embodiment, is a linear array of photosensitive devices, such as charge coupled devices (CODs). The photosensitive devices generate an electrical signal corresponding to the intensity or amount of light received by the photosensitive devices. The linear array that extends substantially across the width of the image receiving member. Alternatively, a shorter linear array may be configured to translate across the image substrate. For example, the linear array may be mounted to a movable carriage that translates across image receiving member. Other devices for moving the light sensor may also be used.

It will be appreciated that variants of the above-disclosed and other features, and functions, or alternatives thereof, may be desirably combined into many other different systems or applications. Various presently unforeseen or unanticipated alternatives, modifications, variations, or improvements therein may be subsequently made by those skilled in the art, which are also intended to be encompassed by the following claims.

What is claimed is:

1. A printhead assembly for use in an imaging device, the printhead assembly including:

a printhead having a faceplate, the printhead being configured to receive liquid ink from an ink source and to eject ink through apertures in the faceplate; and a drip bib mounted to the printhead, the drip bib including:

a plate having a front face, a rear face, an upper edge, and a lower edge; and at least one elongated recess on the rear face of the plate and positioned along the upper edge of the plate that is parallel to the faceplate of the printhead to which the drip bib is mounted and that abuts a lower edge of the faceplate of the printhead to which the drip bib is mounted, the at least one elongated recess offsetting the front face of the plate from the faceplate of the printhead to which the drip bib is mounted to recess the front face of the drip bib with respect to the faceplate of the printhead to which the drip bib is mounted and impede ink from moving from the drip bib to the faceplate of the printhead to which the drip bib is mounted.

2. The drip bib of claim 1 further comprising:

at least one extension extending from the bottom edge of the plate, the extension terminating into a point below the bottom edge of the plate.

3. The drip bib of claim 1 further comprising:

a plurality of extensions extending from the bottom edge of the plate, each extension terminating into a point below the bottom edge of the plate.

4. The drip bib of claim 1 further comprising:

a coating applied to the front face of the plate, the coating consisting essentially of polytetrafluoroethylene and perfluoroalkoxy.

5. The drip bib of claim 3 further comprising:

a coating applied to the front face of the plate, the coating consisting essentially of polytetrafluoroethylene and perfluoroalkoxy.

6. The drip bib of claim 1, wherein the plate has at least one opening in the plate that extends from the front face to the rear face and is positioned between the upper edge and the lower edge, the opening being configured to receive a member by which the drip bib is mounted to the printhead.

7. An imaging device including:

a first upper printhead and a second upper printhead laterally positioned across a width of an image receiving surface and being laterally spaced apart from one another, the first and the second upper printheads each having a faceplate with apertures through which ink is ejected;

a first lower printhead and a second lower printhead laterally spaced across the width of the image receiving surface and being laterally space apart from one another, the first and the second lower printheads each having a faceplate with apertures through which ink is ejected, the first and the second lower printheads being positioned below the first and the second upper printheads and laterally offset from the first and the second upper printheads to enable the first and the second upper printheads and the first and the second lower printheads to eject ink in a continuous line across an image receiving member passing by the first upper, the second upper, the first lower, and the second lower printheads;

a drip bib attached to each of the first and second upper and lower printheads adjacent a lower edge of the faceplates of the first and the second upper and lower printheads, each drip bib comprising:

a plate having a front face, a rear face, an upper edge, and a lower edge; and at least one elongated recess on the rear face of the plate and positioned along the upper edge of the plate that is parallel to the faceplate of the printhead to which the drip bib is attached and that abuts a lower edge of the faceplate of the printhead to which the drip bib is attached, the at least one elongated recess offsetting the front face of the plate from the faceplate of the printhead to which the drip bib is attached to recess the front face of the drip bib with respect to the faceplate of the printhead to which the drip bib is attached and impede ink from moving from the drip bib to the faceplate of the printhead to which the drip bib is attached.

8. The imaging device of claim 7, the drip bib further comprising:

at least one extension extending from the bottom edge of the plate, the extension terminating into a point below the bottom edge of the plate.

9. The imaging device of claim 7, the drip bib further comprising:

a plurality of extensions extending from the bottom edge of the plate, each extension terminating into a point below the bottom edge of the plate.

10. The imaging device of claim 7, the drip bib further comprising:

a coating applied to the front face of the plate, the coating consisting essentially of polytetrafluoroethylene and perfluoroalkoxy.

11. The imaging device of claim 9, the drip bib further comprising:

a coating applied to the front face of the plate, the coating consisting essentially of polytetrafluoroethylene and perfluoroalkoxy.

12. The imaging device of claim 7, wherein the plate of the drip bib has at least one opening in the plate that extends from the front face to the rear face and is positioned between the upper edge and the lower edge, the opening being configured to receive a member by which the drip bib is mounted to the printhead.

13. The imaging device of claim 8 wherein the extension angles towards the rear face of the plate.

* * * * *